US005205318A

United States Patent [19]

Massaro et al.

[11] Patent Number: 5,205,318

[45] Date of Patent: Apr. 27, 1993

[54] RECIRCULATION HOT WATER SYSTEM

[75] Inventors: Donald J. Massaro, Atherton; Herbert E. Thompson, Los Gatos, both of Calif.

[73] Assignee: Sjoberg Industries, Inc., Mountain View, Calif.

[21] Appl. No.: 917,509

[22] Filed: Jul. 21, 1992

[51] Int. Cl.[5] ..... F16K 49/00

[52] U.S. Cl. ..... 137/337; 251/129.04; 126/362; 417/32; 137/565

[58] Field of Search ..... 137/337, 565; 126/362; 417/32; 251/129.04

[56] References Cited

U.S. PATENT DOCUMENTS

| | | | |
|---|---|---|---|
| 2,842,155 | 7/1958 | Peters | 137/337 |
| 3,741,195 | 6/1973 | Ellis | 126/362 |
| 4,160,461 | 7/1979 | Vataru et al. | 137/337 |
| 4,321,943 | 3/1982 | Haws | 137/337 |
| 4,331,292 | 5/1982 | Zimmer | 237/19 |
| 4,518,007 | 5/1985 | Haws | 137/337 |
| 4,697,614 | 10/1987 | Powers et al. | 137/337 |
| 4,798,224 | 1/1989 | Haws | 137/337 |
| 4,896,658 | 1/1990 | Yonekubo et al. | 126/362 |
| 4,930,551 | 6/1990 | Haws | 137/337 |
| 5,009,572 | 4/1991 | Imhoff et al. | 417/32 |
| 5,042,524 | 8/1991 | Lund | 137/337 |

*Primary Examiner*—A. Michael Chambers
*Attorney, Agent, or Firm*—Rosenblum, Parish & Isaacs

[57] ABSTRACT

Recirculation hot water system including a fluid delivery system used to supply potable water throughout a home or other facility, having a hot water supply pipe, a cold water supply/return pipe, a hot water heater, a pump, a manifold, a control system, a hot water and cold water faucet or valve, and a demand site (typically a sink or wash basin). The manifold further includes a thermostatic actuator and a check valve. The control means further includes a sending unit, installed in close proximity to the demand site, and a receiving unit, installed in close proximity to the heater. Command signals are transferred, from the sending unit to the receiving unit, via modulated signals that pass through the AC power lines that are used to distribute power throughout the home or facility. The main potable water supply is bifurcated into the hot water and cold water supply pipes with the heater installed in the hot water supply pipe upstream of the manifold, and the pump installed between the heater and the manifold and in close proximity to the heater. The hot and cold water supply pipes are in fluid communication with separate inlets to the manifold. An outlet from the manifold is in fluid communication with a cold water valve, while another outlet from the manifold is in fluid communication with a hot water valve. The manifold is internally ported such that the hot and cold water supply pipes are in fluid communication with each other.

5 Claims, 10 Drawing Sheets

1000

RECIRCULATION HOT WATER SYSTEM

BACKGROUND OF THE INVENTION

1. Field of the Invention

The present invention relates generally to a potable water delivery system wherein hot water is circulated to a user outlet and more particularly to a potable water delivery system wherein water in the higher temperature water supply pipe is circulated into the lower temperature water supply pipe for return to a hot water heater.

2. Brief Description of the Prior Art

There is a great need to conserve natural resources such as water. Unfortunately, many potable water delivery systems are not designed to conserve water, rather these systems cause many gallons of water to be wasted.

Many potable water delivery systems, for example, deliver the fluid at both a "hot" and a "cold" temperature. In many of these delivery systems the water is heated by a water heating device which is located a considerable distance away from the location where the water is drawn from the delivery system. That is, the hot water faucet is located a considerable distance away from the water heater device.

Referring now to FIG. 1, which schematically illustrates a typical prior art potable water delivery system 100, potable water is inletted in the direction shown by an arrow 102, through a potable water supply pipe 103. At a T-joint 104, the potable water flows .through a cold water supply pipe 106 and through a water heater inlet pipe 108. The pipe 106 is in fluid communication with a cold water isolation valve 125.

The valve 125 is communicatively coupled, via a cold water riser pipe 127, to a cold water valve 114. The valves 125 and 114 are operated by handles 130 and 118, respectively. Potable water flowing through the pipe 106 flows through the valves 125 and 114 and, through a cold water spout 116 into a basin or sink 126.

The pipe 108 is communicatively coupled to a water heater 110. Potable water flows into the heater 110 where it is heated to a predetermined temperature level. The heater 110 is in fluid communication, via a hot water supply pipe 112, with a hot water isolation valve 128. Valve 128 is communicatively coupled, via a hot water riser pipe 129, to a hot water valve 120. The valves 120 and 128 are operated by handles 132 and 124, respectively. Potable water flowing through pipe 108 is heated by the heater 110 and flows through the pipe 112 through the valves 128 and 120, and through a hot water spout 122 into the sink. It should be further noted that the valves 125 and 128 are located beneath the sink 126, while the valves 114 and 120 are located above the sink 126.

Typically, there is infrequent use of hot potable water. Consequently, the water in the pipes 112 and 129 loses its heat through convective heat transfer with the ambient environment. Insulation wrapped about the pipes 112 and 129 may reduce the heat transfer through the pipe walls, but eventually the water in pipes 112 and 129 becomes cold. That is, the temperature of the water initially drawn from the spout 122 is unsatisfactorily cold for "hot" water purposes (i.e. washing, or cleaning). The result is that when the valve 120 is opened, the "cold" water in pipes 112 and 129 is purged before "hot" water is available from spout 122. Normally this purged water is not saved and is allowed to flow into a drain and is wasted. The amount of the purged water that is wasted can be several gallons and depends on the frequency of hot water usage, the length and diameter of the pipes 112 and 129, the ambient temperature, and other factors.

There have been several different devices utilized in prior art liquid delivery systems to conserve water. One device, best characterized as a hot water recovery system, is epitomized by four U.S. Patents issued to Haws, U.S. Pat. Nos. 4,321,943 (issued Mar. 30, 1982), 4,518,007 (issued May 21 1985), 4,798,224 (issued Jan. 17, 1989), and 4,930,551 (issued Jun. 5, 1990). Haws teaches connecting the hot and cold water supply piping at a location slightly upstream of the hot and cold water valves. A pressure reducing valve, installed upstream of the hot water heater, maintains the hot water supply pressure at a lower level than the pressure in the cold water supply piping. When the hot water valve is closed, the pressure in the cold water piping is greater than the pressure in the hot water piping, causing the cold water to flow into the hot water piping thereby back-flowing the hot-cold water mix through the hot water supply piping and into the water heater. The water heater serves as an accumulator for the heated water. Cold water replaces hot water in the hot water supply piping thus no thermal energy is transferred from the fluid contained within the hot water supply piping to the environment. The shortcoming of this approach is that when the hot water faucet is opened, the hot water supply line must still be purged of the cold water which back-flowed into the hot water supply line. This device does not reduce the amount of cold water that must be purged (i.e. wasted) from the hot water supply line before usable hot water can be drawn from the faucet.

Yet other devices designed to conserve water in a liquid delivery system are disclosed in Vataru et al. U.S. Pat. No. 4,160,461 (issued Jul. 10, 1979), and Powers et al. U.S. Pat. No. 4,697,614 (issued Oct. 16, 1987). The common elements in the devices disclosed in these patents are an accumulator and a crossover pipe communicatively coupling the hot water supply piping to the cold water supply piping. In Powers et al., an accumulator installed in the crossover pipe receives the cold water from the hot water supply line. The cold water is stored in the accumulator until it is discharged out of the cold water spout as usable cold water. Thus, cold water from the hot water supply pipe is pumped into a storage container (i.e., accumulator) and saved for later use. The cold water is not wasted by pouring it down the drain. In Vataru et al., an accumulator stores the cold water received from the hot water supply line; the cold water is mixed with hot water eventually received from the hot water heater line; when the cold water is heated to a predetermined temperature level it is made available at the hot water faucet. The problem with these approaches is that a retrofit of existing plumbing installations is significantly complicated when an accumulator is a required component of the liquid delivery system. The installation of the accumulator into an existing delivery system is very likely beyond the capability of most homeowners and would require special knowledge or experience, or tools.

Yet another prior art apparatus is typified by Ellis U.S. Pat. No. 3,741,195 (issued Jun. 26, 1973). In Ellis, the water heater is installed beneath the vanity or sink thereby minimizing the length of the hot water supply pipe and the amount of cold water purged from the hot water supply line. This system is clearly impractical for a typical home where there are a plurality of basins, tubs, and showers. It would be highly impractical, not to mention prohibitively costly, to install an individual heater unit at the location of each basin, tub or shower.

Another device used to conserve water in liquid delivery system circulates water from the hot water supply pipe to the cold water supply pipe. Typical recirculation systems are disclosed in Peters U.S. Pat. No. 2,842,155 (issued Jul. 8, 1958), Zimmer U.S. Pat. No. 4,331,292 (issued May 25, 1982), and Imhoff et al. U.S. Pat. No. 5,009,572 (issued Apr. 23, 1991).

Referring now to FIG. 2 which schematically depicts a potable water delivery system with recirculation 200 as taught by Peters and Zimmer. A crossover pipe 202 has been installed in the delivery system 100 (FIG. 1) and communicatively couples the hot water riser pipe 129 to the cold water riser pipe 127. The pipe 202 includes a bypass device 208, an inlet pipe 220, and an outlet pipe 222. One end of the inlet pipe 220 is mechanically connected to a T-joint 206 installed in the riser pipe 129. The other end of the inlet pipe 220 valve is mechanically connected to an inlet port connection 207 disposed in the bypass device 208. In similar fashion, one end of the outlet pipe 222 is mechanically connected to a T-joint 212 installed in the riser pipe 127. The other end of the outlet pipe 222 valve is mechanically connected to an outlet port connection 209 disposed in the bypass device 208. Thus, the bypass device is communicatively coupled to the riser pipes 127 and 129. The bypass device includes a check valve 218 and a thermostatic valve 216.

In operation, if the temperature of the water in the hot water riser pipe 127 and the inlet pipe 220 is generally at the temperature level of the cold water in the cold water riser pipe 127 and the outlet pipe 222, then the thermostatic valve 216 opens thereby allowing the water to circulate, in the direction shown by arrow 226, from the hot water riser pipe 129 to the cold water riser pipe 127. The water in the hot water supply pipe 112 is circulated, in the direction shown by an arrow 224, into the pipe 106 (FIG. 1) which now functions as a cold water supply/return pipe 201. Water recirculates in this manner until the water in the water flowing through the riser pipe 129 and the pipe 220 reaches a predetermined temperature level. When the predetermined temperature level is reached, the valve 216 closes thereby preventing the water from circulating into the piping 222 and 201. When valve 216 closes, water, in the pipe 112, flows in the direction of an arrow 228, through the riser pipe 129, through the valve 120 and through the spout 122 into the sink 126. Water, in the pipes 112 and 129, is not purged from the system but is circulated within the system until it is heated to a usable temperature level.

The problem with these devices is that they depend on the density difference between the hot and cold water to provide a pressure head that will cause a convection flow through the crossover pipe. This implies that the hot water heater must be at a lower elevation than the faucet. The absence of a pump in the Peters and Zimmer devices creates doubt that these devices will work properly.

In Imhoff et al., a crossover device similar to the Peters and Zimmer devices, connects the hot and cold water supply pipes. Referring now to FIG. 3, which schematically illustrates a potable water delivery system with pumped recirculation 300 taught by Imhoff et al. A crossover pipe 301 has been installed in the delivery system 100 (FIG. 1) and communicatively couples the hot water riser pipe 129 to the cold water riser pipe 127. The pipe 301 includes a solenoid valve 304, a thermostat 306, a pump 308, a temperature sensor 310, a pipe 312, a pipe 314, an inlet pipe 321, and an outlet pipe 323. An enclosure 302 houses the valve 304, the thermostat 306, the pump 308 and the sensor 310. One end of the inlet pipe 321 is mechanically connected to the T-joint 206 installed in the riser pipe 129. The other end of the inlet pipe 321 valve is mechanically connected to the temperature sensor 310. The sensor 310 is communicatively coupled, via the pipe 312, to the pump 308. The pump 308 is communicatively coupled, via the pipe 314, to the solenoid valve 304. In similar fashion, one end of the outlet pipe 323 is mechanically connected to the T-joint 212 installed in the riser pipe 127. The other end of the outlet pipe 323 valve is mechanically connected to the solenoid valve 304. Thus, the crossover pipe 301 is communicatively coupled to the riser pipes 127 and 129. In addition, the thermostat 304 is communicatively coupled to the pump 308 (via a pump energize signal line 318), to the temperature sensor 310 (via a temperature level signal line 316), to the solenoid valve 304 (via a valve energize signal line 320). Finally, AC power to the system is provided from a wall outlet 328 with two receptacles 326 and 327 that are located beneath the sink 126 and in close proximity to the crossover pipe 302. One end of a power cord 322 is communicatively coupled to the thermostat 306. The other end of the cord 322 is fitted with a standard three-prong plug 324 which can be inserted into the receptacle 326.

In operation, the plug 324 is inserted into the receptacle 326, thereby supplying power to the electrical components (i.e., valve 304, pump 308, sensor 310, and thermostat 306) installed on the pipe 301. If the temperature of the water in the pipes 321 and 129, as sensed by the sensor 310, is below a predetermined level the sensor 310 will generate a temperature level signal and transmit it over the signal line 316. The thermostat 306, in response to the signal, will energize the pump 308, and energize and position the solenoid valve 304 to allow the water to be circulated from the hot water riser pipe 129, through the crossover pipe 301, and into the cold water riser pipe 127. Water is circulated from the hot water supply to the cold water supply piping, in the general direction of the arrows 224 and 226, until the water heats up to the predetermined temperature level. When the temperature sensor 310 senses that the water in the hot water supply riser pipe 129 and the inlet pipe 220 is at the predetermined level, then the sensor 310 transmits a new temperature signal over the signal line 316. In response to the new signal, the thermostat 306 de-energizes the pump 308 (via signal line 318) and de-energizes the solenoid valve 304 (via the signal line 320) thereby positioning the valve 304 to stop the water flow through the crossover pipe 302. The water, at the predetermined temperature level (i.e. "hot" water) flows, in the general direction of the arrow 228, through the hot water riser pipe 129 and out of the spout 122.

The major problem with the Imhoff et al. device is that electrical components (i.e. the pump, solenoid valve, thermostat, and sensing device) are installed in the crossover pipe. When the crossover pipe is installed beneath existing sinks, basins, tubs, or showers both mechanical and electrical connections must be made. In addition, an electrical power outlet must be in close proximity to the crossover pipe in order to supply power to operate the pump and the other electrical components. If a crossover pipe as disclosed by Imhoff et al. is used to conserve water in an existing liquid delivery system, the retrofit installation of the crossover pipe into the delivery system will be needlessly complex and difficult.

SUMMARY OF THE PRESENT INVENTION

It is therefore an object of the present invention to provide an apparatus for conserving water, that enables an existing hot and cold water delivery system to deliver, on demand, the hot water to an outlet faucet without having to initially purge water from the delivery system thereby conserving significant gallons of potable water.

Another object of the present invention is to provide an apparatus for conserving water that is easily retrofitted into an existing water delivery system by the average homeowner or water user.

Yet another object of the present invention is to provide an apparatus for conserving water that can be retrofitted into an existing water delivery system at the location of the faucet, sink, basin, tub, shower or similar device, without the need for special tools.

Still another object of the present invention is to provide an apparatus for conserving water that can be retrofitted into an existing water delivery system at the location of the faucet, sink, basin, tub, shower or similar device, without the need for electrical wiring.

Briefly, a preferred embodiment of the present invention includes a fluid delivery system used to supply potable water throughout a home or other facility, having a hot water supply pipe, a cold water supply/return pipe, a hot water heater, a pump, a manifold, a control system, a hot water and cold water faucet or valve, and a demand site (typically a sink or wash basin). The manifold further includes a thermostatic actuator and a check valve. The control means further includes a sending unit, installed in close proximity to the demand site, and a receiving unit, installed in close proximity to the heater. Command signals are transferred, from the sending unit to the receiving unit, via modulated signals that pass through the AC power lines that are used to distribute power throughout the home or facility. The main potable water supply is bifurcated into the hot water and cold water supply pipes. The cold water supply pipe is in fluid communication with an inlet to the manifold, while the hot water supply pipe is in communication with another inlet to the manifold. An outlet from the manifold is in fluid communication with a cold water valve, while another outlet from the manifold is in fluid communication with a hot water valve. The manifold is internally ported such that the hot and cold water supply pipes are in fluid communication with each other. The heater is installed in the hot water supply pipe upstream of the manifold, with the pump installed between the heater and the manifold and in close proximity to the heater. If hot water is desired, the sending unit sends a modulated command signal to the receiving unit which, in turn, energizes the pump. If the water temperature present in the hot water supply pipe is below a predetermined temperature level, the thermostatic actuator opens to allow water to circulate from the hot water supply pipe to the cold water supply pipe. On the other hand, if the water temperature present in the hot water supply pipe is above the predetermined temperature level, the thermostatic actuator closes to prevent any circulation between the two supply pipes, thereby allowing water at the predetermined temperature level (i.e. "hot" water) to flow through the hot water valve and into the sink or basin.

A primary advantage of the present invention is that it provides an apparatus that enables an existing water delivery system to deliver, on demand, the hot water to an outlet faucet without having to initially purge water from the delivery system piping thereby conserving significant gallons of potable water.

Another advantage of the present invention is that it provides an apparatus that is easily retrofitted into an existing water delivery system.

Yet another advantage of the present invention is that it provides an apparatus that can be retrofitted into an existing water delivery system at the location of the faucet, sink, basin, tub, shower or similar device, without the need for special tools or electrical wiring.

These and the other objects and advantages of the present invention will no doubt become apparent to those skilled in the art after having read the following detailed description of the preferred embodiment illustrated in the several figures of the drawing.

IN THE DRAWING

DESCRIPTION OF THE PREFERRED EMBODIMENT

Figure 1:
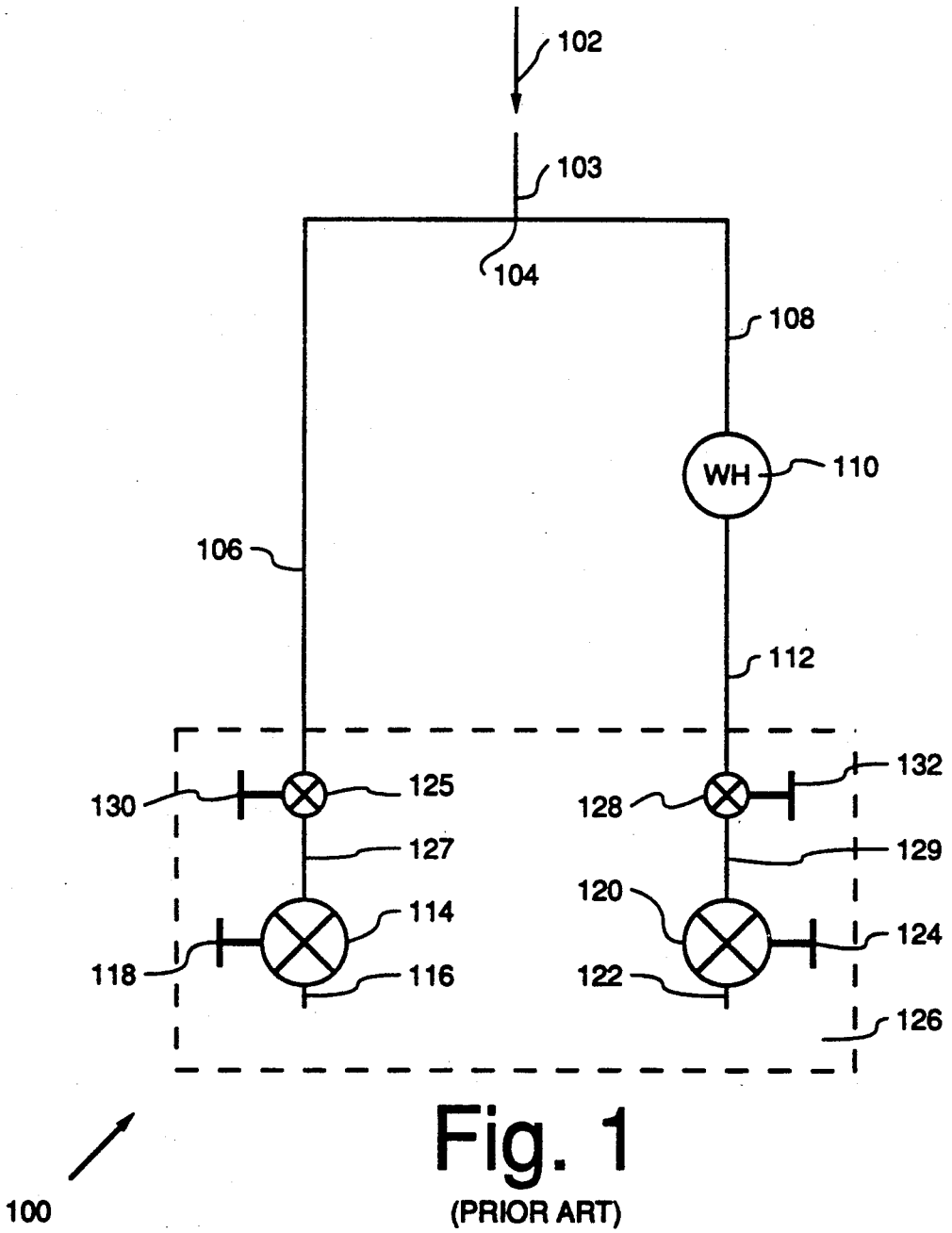
Fig. 1 (PRIOR ART)
FIG. 1 is a schematic drawing of a potable water distribution system, typical in the prior art, wherein water at different temperatures is delivered via different and unconnected supply pipes.
Figure 2:
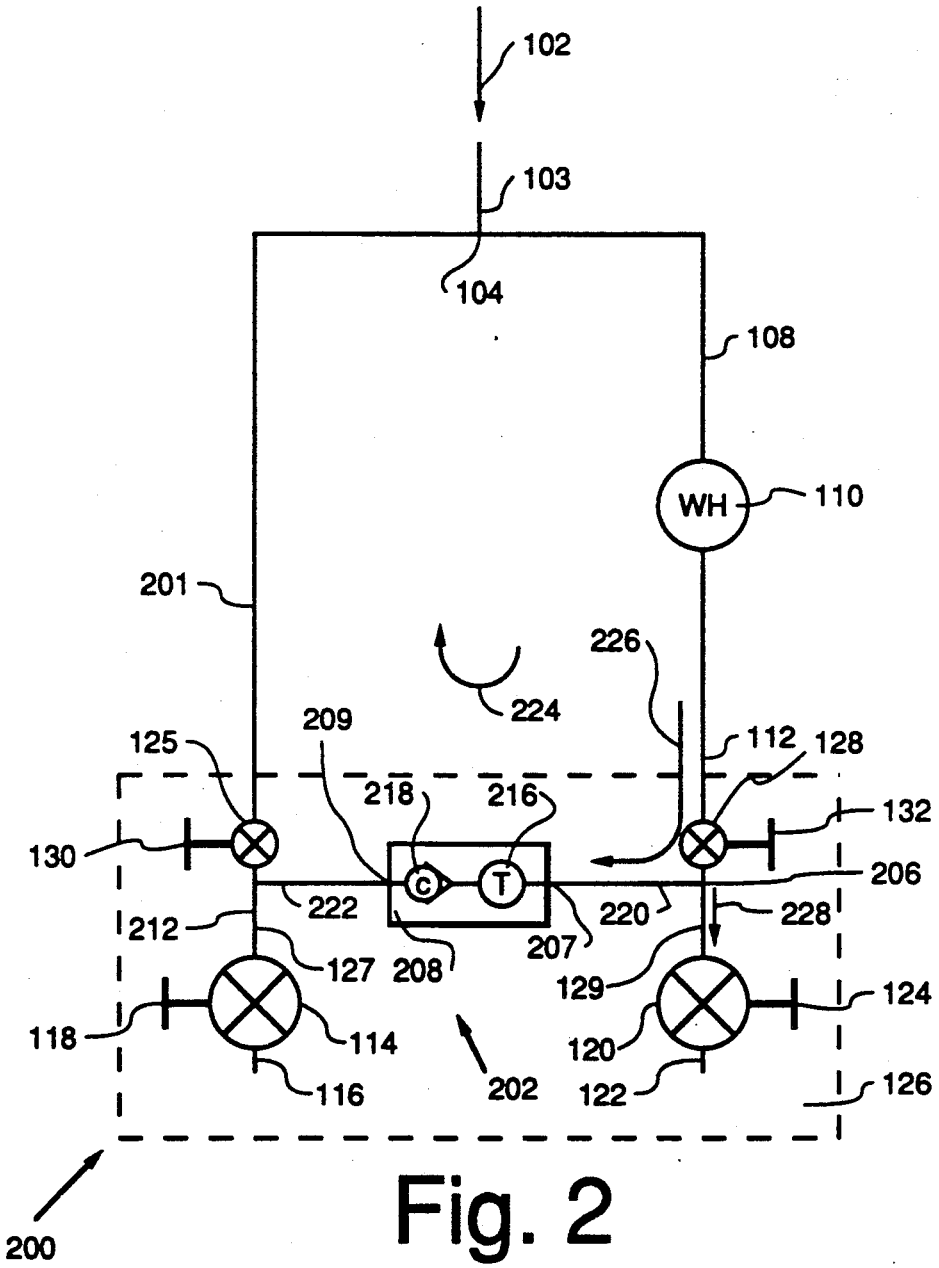
Fig. 2 (PRIOR ART)
FIG. 2 is a schematic drawing of a potable water distribution system, typical in the prior art, wherein water below a predetermined temperature level is recirculated from the hot water supply pipe to the cold water supply pipe.
Figure 3:
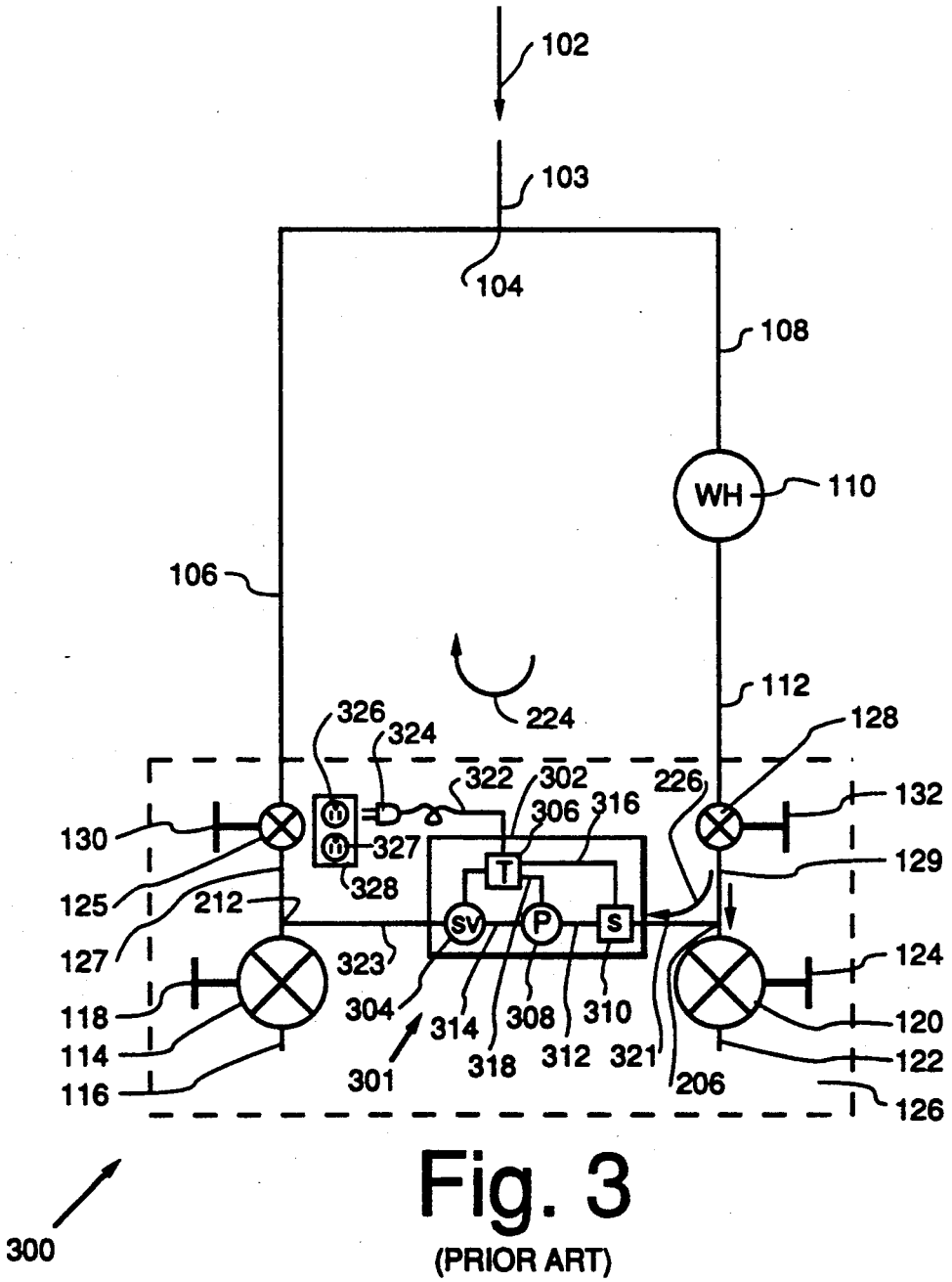
Fig. 3 (PRIOR ART)
FIG. 3 is a schematic drawing of a potable water distribution system, typical in the prior art, wherein water below a predetermined temperature level is recirculated, using a pump, from the hot water supply pipe to the cold water supply pipe.
Figure 4:
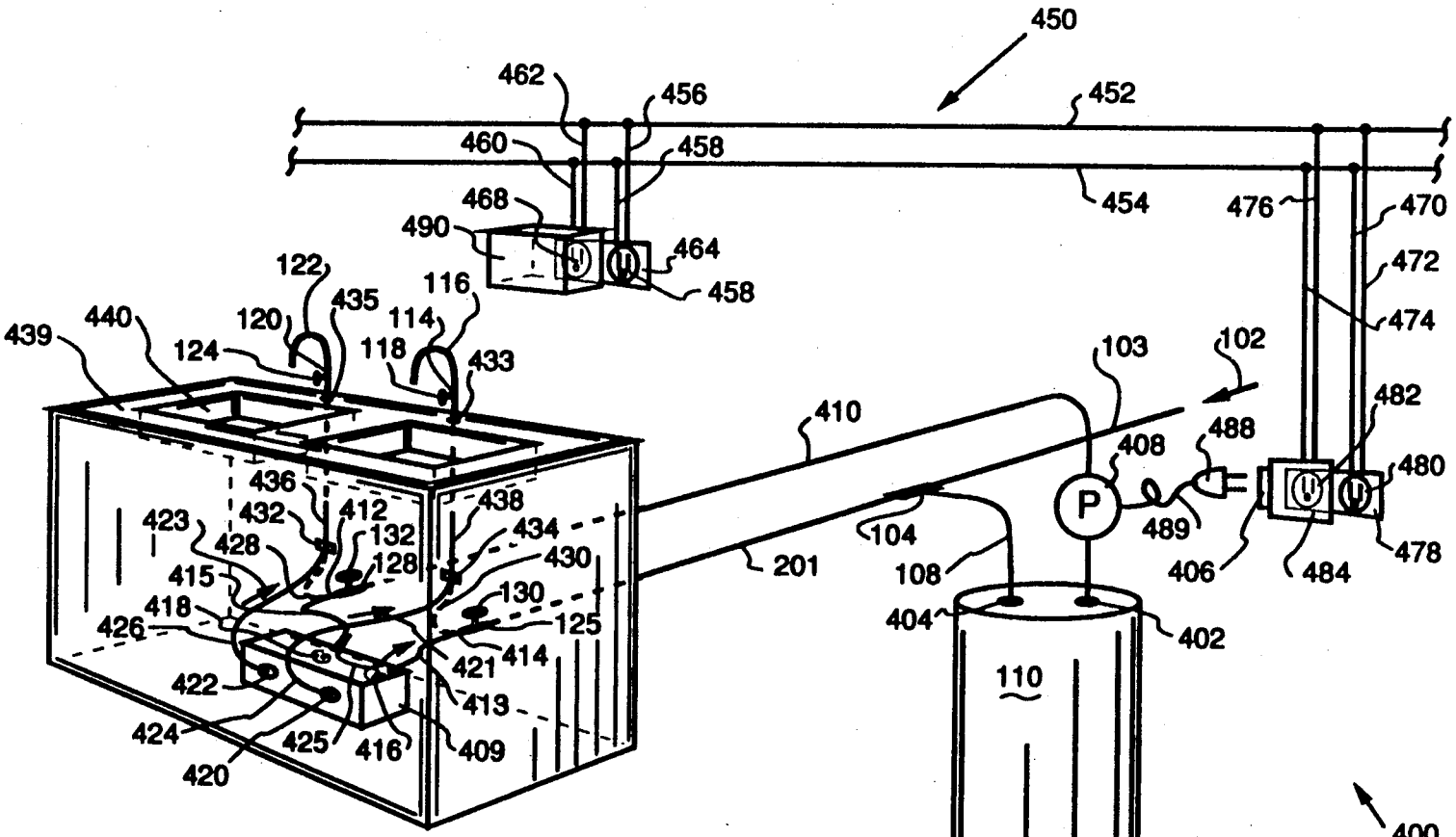
FIG. 4 is a schematic drawing of the preferred embodiment of the recirculation hot water system that is installed in a home or other facility.

Referring now to FIG. 4 wherein is illustrated a recirculation hot water system 400 of the present invention. The system 400 can be installed in a typical home or any other facility wherein delivery of hot potable water is required. The system 400 includes portions of a typical prior art potable water delivery system and also includes a pump 408, a signal receiving unit 484, a signal sending unit 490, and a manifold 409. The main inlet potable water supply flows in the direction of the arrow 102 through the supply pipe 103 to the T-joint 104. The potable water flow is bifurcated at the joint 104 and flows through the pipe 201 and the pipe 108. The water heater 110 is communicatively coupled, via the pipe 108, the T-joint 104, a water heater inlet connection 404, and to the pipe 201. The pump 408 is communicatively coupled, via a heater outlet pipe 406, to the water heater 110 at a water heater outlet connection 402. The T-joint 104 is communicatively coupled to the valve 125 and 130 via the pipe 201; the pump 408 is communicatively coupled, via a pump discharge piping 410, to the valve 128. The manifold 409 is in fluid communication with the valve 128 via a hot water supply pipe 415. Also, the manifold 409 is in fluid communication with the valve 125 via a cold water supply pipe 413. One end of the pipe 415 is connected to a manifold hot water inlet connection 418, while the other end of the pipe 415 is connected to a valve outlet connector 412. In similar fashion, one end of the pipe 413 is connected to a manifold cold water inlet connection 416, while the other end of the pipe 413 is connected to a valve outlet connector 414. The manifold 409 is also in fluid communication with a hot water riser pipe 436 (via a hot water supply pipe 426), and a cold water riser pipe 438 (via a cold water supply 424). One end of the pipe 426 is communicatively coupled to a connector 432, while the other end of the pipe 426 is communicatively coupled to a manifold hot water outlet connection 422. In similar fashion, one end of the pipe 424 is communicatively coupled to a connector 434, while the other end of the pipe 424 is communicatively coupled to a manifold cold water outlet connection 420. The pipe 436 passes through an opening 435 formed in a counter-top 439 and is in fluid communication with the valve 120. In similar fashion, the pipe 438 passes through an opening 433 formed in the counter-top 439 and is in fluid communication with the valve 114. Valves 120 and 114 are communicatively coupled to their corresponding spouts 122 and 116.

The signal sending unit 490 is plugged into a receptacle 468 of a wall outlet 464. The wall outlet 464 is located close to the sink 440 or the valves 120 and 114. The receptacle 468 and receptacle 466 are communicatively coupled to an alternating current (AC) supply power line 452 and an alternating current (AC) return power line 454 via an AC supply power line 462 and 458, and an AC return power line 460 and 456. The signal receiving unit 484 is plugged into a receptacle 482 of a typical wall outlet 478. The wall outlet 478 is located in close proximity to the pump 408. The power to the pump 408 is supplied via a power cord 489 wherein one end of the power cord 489 is attached to a three-pronged plug 488 which in turn is plugged into a connector 486 disposed on side of the receiving unit 484. The receptacle 482 and a receptacle 480 are communicatively coupled with the supply power line 452 and the return power line 454 via an AC return power line 470 and 474, and an AC supply power line 472 and 476.

It will be appreciated from the figure that the installation of the manifold 409 into an existing potable water delivery system is a very simple and straightforward task. Before installation of the manifold, the cold water passes through the valve 125, a cold water supply pipe 43, the cold water riser pipe 438, the valve 114, and the spout 116. In similar fashion, the hot water would pass through the valve 128, a hot water supply pipe 428, the riser pipe 436, the valve 120, and the spout 122. It should be noted that pipes 430 and 428 are flexible pipe lines, as are pipes 415, 413, 426 and 424. In order to install the manifold 409, the connection between pipes 430 and 438 (i.e., connector 434) is unmade; likewise the connection between pipes 428 and 436 is unmade. The pipes 430 and 428 can be discarded or, in the alternative, used as pipes 413 and 415 to connect to manifold 409. Pipes 426 and 424 (typically supplied with the manifold 409) are then connected as shown in FIG. 4. Since these pipes are flexible lines, installation of the manifold 409 is very straightforward and does not require special knowledge, experience or tools.

Figure 5:
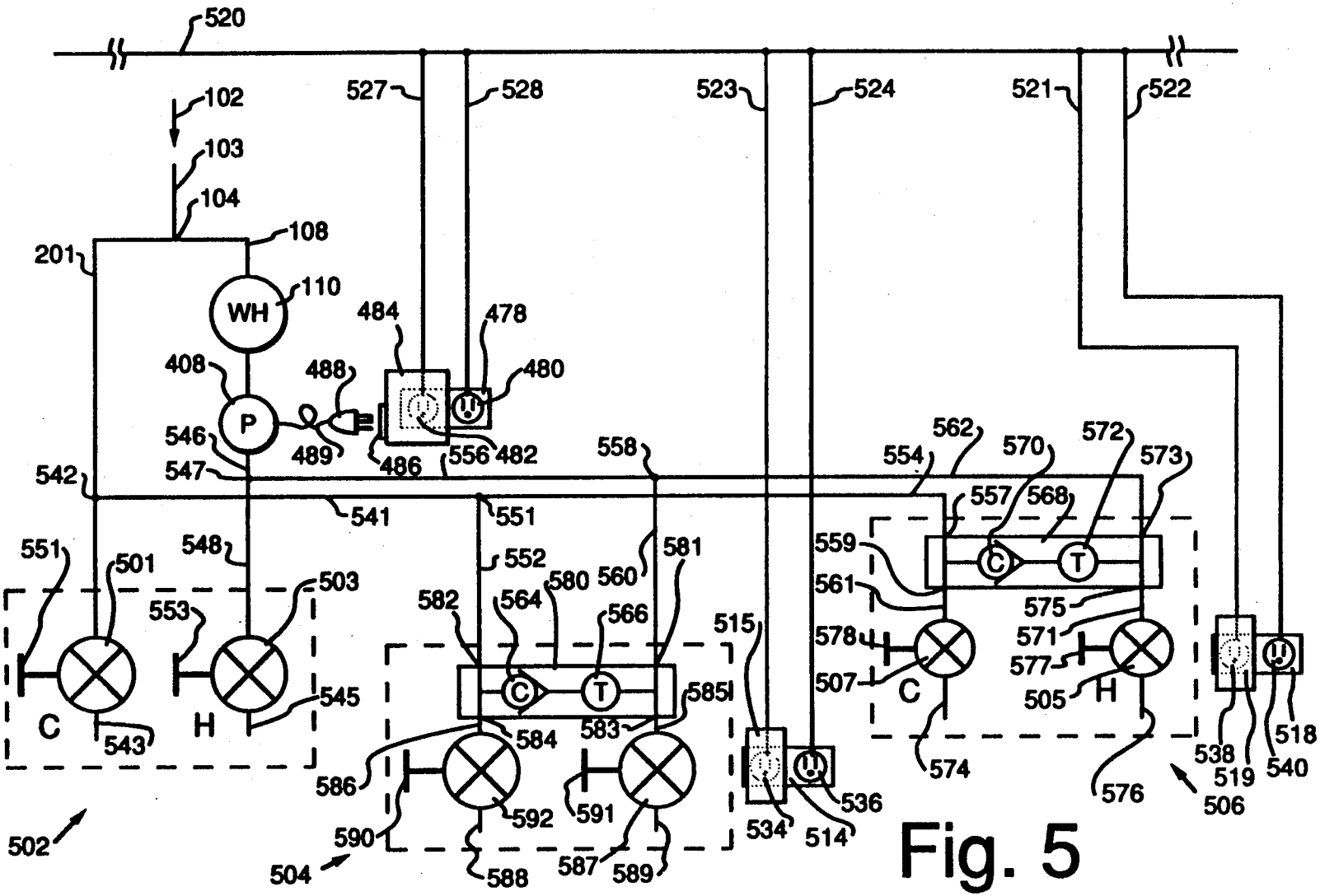
FIG. 5 is a schematic drawing of the preferred embodiment of the recirculation hot water system that supplies a plurality of demand sites.

Referring now to FIG. 5 wherein is illustrated a schematic depiction of a multi-location recirculation hot water system 500. Three representative demand sites are illustrated in FIG. 5. A demand site 502 does not feature a manifold, whereas a demand site 504 and a demand site 506 utilize a manifold to provide the recirculation of water from the hot water supply piping to the cold water supply piping. Potable water flows in the direction of the arrow 102 through the pipe 103 and is bifurcated by the T-joint 104 to flow through the pipes 108 and 201.

The flow through the pipe 108 through the heater 110 and through the pump 408 is then passed through a water heater outlet pipe 546 and then into a T-joint 547. The water flow is further split to flow through a supply pipe 548 and a supply pipe 556. The water flowing through the pipe 548 flows to the site 502. The water flowing through the pipe 546 is subsequently split into two flow streams by a T-joint 558. One flow stream flows through a supply pipe 560 to site 504, while the other flow stream flows through a supply pipe 562 to the site 506.

Water is supplied, via the pipe 201, to the site 502. The water flow through pipe 201 is also split into another flow passing through a supply/return pipe 550 due to the presence of a T-joint 542 installed in the pipe 201. Water flowing in pipe 550 is further split by a T-joint 551 into two other flow streams. One stream flows through a supply/return pipe 552 to the site 504. The other stream flows through a supply/return pipe 554 to the site 506.

Demand site 502 includes an enclosure 508, a cold water valve 501, a hot water valve 503, and their associated handles 551 and 553, and spouts 543 and 545. It should be noted that isolation valves (e.g. valves 125 and 128 shown in FIG. 4) are installed at each demand site but have not been illustrated in FIG. 5.

Demand site 504 includes a cold water valve 592 and a hot water valve 587; also included are the associated faucet handles 590 and 591, and spouts 588 and 589. In addition, the pipe 560 is communicatively coupled through the pipe 552 via a manifold 580. The manifold includes a check valve 564 and a thermostat 566. The manifold 580 is in fluid communication with the pipe 560 via a manifold hot water inlet connection 581. The manifold is similarly in fluid communication with the pipe 552 via a manifold cold water inlet connection 582. The manifold 580 is in fluid communication with the hot water valve 587 via a hot water supply pipe 585 which is communicatively coupled to a manifold hot water outlet connector 583. In similar fashion, the manifold 580 is in fluid communication with the cold water valve 592 via a cold water supply pipe 586 which in turn is communicatively coupled to a manifold cold water outlet connection 584.

The demand site 506 also includes a manifold 568 and a cold water valve 507, and a hot water valve 505. The cold water valve includes a handle 578 and a spout 574, while the hot water valve 505 includes a handle 577 and a spout 576. The pipe 562 is in fluid communication with the pipe 554 via the manifold 568. The manifold 568 includes a check valve 570 and a thermostat 572. The manifold 568 is communicatively coupled to the pipe 562 at a manifold hot water inlet connection 573, while the manifold 568 is communicatively coupled to the pipe 554 via a manifold cold water inlet connection 557. Similarly, the manifold 568 is in fluid communication, via a hot water supply pipe 571 and a manifold hot water outlet connection 575, with the hot water valve 505. The manifold 568 is also in fluid communication, via a cold water supply pipe 561 and a manifold cold water outlet connection 559, with the cold water valve 507.

A signal sending unit 515 is plugged into a receptacle 534 of a wall outlet 514. The wall outlet is located in close proximity to site 504. The receptacle 534 and a receptacle 536 are communicatively coupled to an alternating-current (AC) main power line 520 via an AC power line 523 and an AC power line 524. It should be noted that the main power line 520 represents both an AC supply power line and an AC return power line (e.g., power lines 452 and 454 of FIG. 4). Also, power line 523 (and 524) represents both an AC supply and an AC return power line.

In similar fashion, a signal sending unit 519 is plugged into a receptacle 538 of a wall outlet 518. The wall outlet is located in close proximity to site 506. The receptacle 538 and a receptacle 540 are communicatively coupled to the power line 520 via an AC power line 521 and an AC power line 552. Similar to demand site 504, the power line 521 (and 522) represents both an AC supply and an AC return power line.

As described earlier, the pump 408 is connected to the cord 489, one end of which is mated to the plug 488. The plug 488 is plugged into the connector 486 which is mounted on the receiving unit 484. The receiving unit 484 is plugged into the receptacle 482 of the wall outlet 478 which is close proximity to the pump 408. The receptacles 482 and 480 are communicatively coupled to the power line 520 via an AC power line 527 and an AC power line 528. As indicated above, the power line 527 (and 528) represent both AC supply and AC return power lines.

It should be noted that although three demand sites have been illustrated, the preferred embodiment will work with a plurality of demand sites and is not limited to only three. It should also be noted that a manifold is not required at every demand site. From the figure it is apparent that a manifold should be installed at the demand site that is the furthest away from the pump. In the case of the system illustrated in FIG. 5, the demand site 506 is the furthest away from the pump 408, and consequently the manifold 568 is installed at that site. A manifold is not required at the demand site 502 because of its proximity to the pump 408. The manifold 580 is not required to be installed at the demand site 504, but one could be if desired. The decision to install the manifold depends upon the length of the supply pipe 560 from the inlet connection 581 to the T-joint 558. Cold water contained in this segment of piping will not be evacuated unless there is a manifold (i.e., item 580) installed between the pipe 560 and the return pipe 552.

Figure 6:
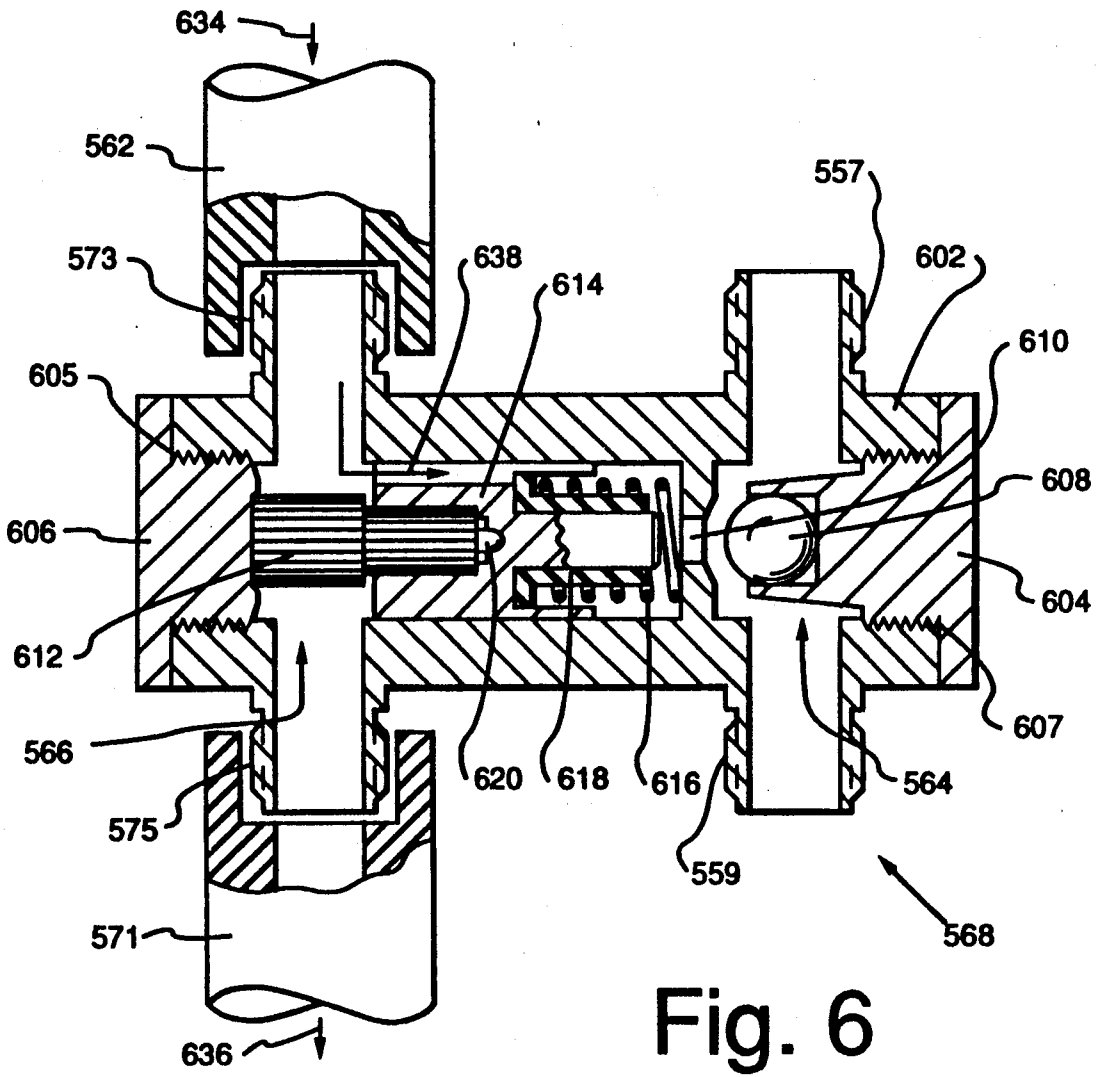
FIG. 6 is a partial sectional drawing of a manifold component illustrated in FIG. 4 and 5.

Referring now to FIG. 6 wherein is illustrated a cross-sectional view of the manifold 568, it should be noted that although the manifold 568 has been illustrated, the other manifolds illustrated in other figures are identical. The manifold 568 is mechanically coupled at the hot water inlet connection 573 to the supply pipe 562, and at the hot water outlet connection 575 to the supply pipe 571. It should be noted that the mechanical connections, via connections 557 and 559, to the supply/return pipe 554 and to the cold water supply pipe 561 have not been shown in the figure. The manifold 568 includes a manifold body 602, an end cap 604, an end cap 606, a thermostat 566, and a check valve 564. The check valve 564 includes a ball check valve 608 and an orifice 610. The thermostat 566 includes a thermostatic actuator 612, a piston 620, a rubber seal 618, a spring 616, and a shuttle 614. The end cap 606 is screwed into one end of the manifold body 602. An O-ring 605 provides a fluid-proof seal between the end cap 606 and the manifold body 602. The end cap 604 is screwed into the other end of the body 602, and an 0-ring 607 provides a fluid-proof seal between the end cap 604 and the manifold body 602. The thermostatic actuator 612 is a product of Robertshaw Controls Company under the trade name "POWER PILL" and is mounted to the inner face of the end cap 606. The other end of the thermal actuator 612 is inserted into one end of the shuttle 614. The rubber seal 618 is held firmly against the other end of the shuttle 614 by the spring 616. The ball check valve 608 is held in place in a recess formed in the inner surface of the end cap 604.

The full stroke of the piston 620 is approximately ¼". As the piston 620 extends, it moves the shuttle 614 towards the orifice 610 that is to be closed. Because the amount of piston stroke is dependent upon the temperature and because the orifice must be closed at a defined temperature, the piston 620 will continue to move after the orifice 610 is closed. In this case, it is desired to close the orifice 610 after ⅛" of piston travel. If the mechanical construction stops the piston from extending as temperature continues to increase, the thermostatic actuator 612 will be damaged. To prevent the damage, the manifold design uses the spring 616 and the rubber seal 618 (which serves as both a spring and a seal). As the temperature increases, the piston 620 extends, the rubber seal 618 is forced against the surface around the orifice 610, thereby providing a seal at an intermediate point of the piston travel. Water flows in the direction of the arrows 634 and 638. As the temperature continues to rise and the piston 620 continues to extend: the tubular shape of the rubber seal 618 will allow it to decrease in length while at the same time providing a seal of the orifice 610, and the thermostatic actuator 612 will not be damaged. As the temperatures decrease, the spring 616 will force the piston back into the thermostatic actuator 612 and the orifice 610 will open. Water flows in the direction of the arrows 634 and 636.

In operation, the signal sending unit furthest away from the pump and water heater is operated by the user. The unit, as described earlier, is plugged into a wall outlet that is in close proximity to the demand site. The signal sending unit transmits a modulated signal over the house (or facility) AC power distribution system to the signal receiving unit that is plugged into a wall outlet in close proximity to the pump. Power is transferred to the pump motor via the receiving unit. the temperature, as sensed by the thermal actuator, is below a predetermined level, then the thermal actuator contracts thereby uncovering the orifice opening in the manifold. With the pump motor energized, water passes through the hot water supply pipe, through the orifice, into the cold water pipe, and is either returned back to the water heater or out through the cold water spout. If the temperature, as sensed by the thermal actuator, is at or exceeds a predetermined temperature level (i.e. the water is "hot"), then the actuator extends and covers the orifice opening. Water can not now flow from the hot water supply pipe into the cold water supply pipe. When the flow is stopped by the actuator, the pump may continue to operate and is designed to not be damaged at zero flow. Hot water now may flow through the hot water supply pipe through the hot water riser pipe and out through the hot water spout.

The control signal sent to the receiving unit can be a simple on-off signal thereby energizing the pump motor with one signal, and de-energizing the pump motor with another signal. In the alternative, the sending unit could send a time duration signal that would energize the pump motor but only for a predetermined period of time. During this time period, water may be circulated from the hot water pipe, through the manifold, and into the cold water pipe.

Figure 7:
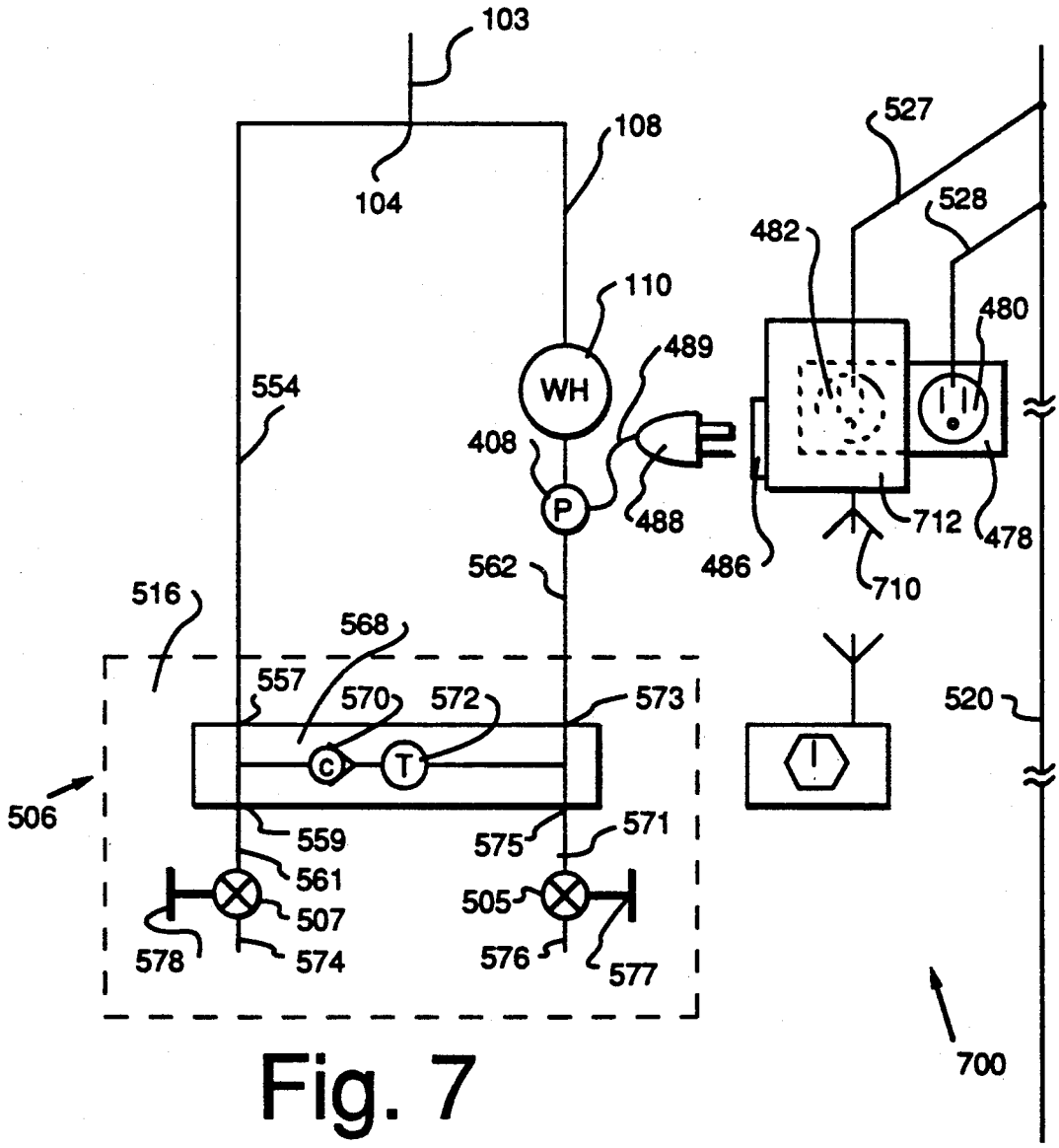
FIG. 7 is a schematic drawing of an alternate embodiment of the recirculation hot water system, wherein control signals are transmitted by radio frequency signals.

Although a preferred embodiment of the present invention utilizing modulated signals transmitted over the house AC power lines has been disclosed as the preferred embodiment, it will be appreciated that in the alternative commands can be transmitted by modulated radio carrier waves. Referring now to FIG. 7 wherein is schematically illustrated a potable water delivery system 700. It should be noted that the system 700 can be used in either single or multiple demand site systems. The system 700 represents the farthest demand site 506 depicted in FIG. 5, and does not show the remaining demand sites 504 and 502.

In system 700, commands are transmitted from a sending unit 706 via a transmitting antenna 708 to a receiving antenna 710 which is mounted on a signal receiving unit 712. The sending unit 706 is in close proximity to the demand site 506, while the receiving unit 712 is situated nearby the pump. The command transmission is accomplished by modulated radio carrier waves rather than dedicated transmission lines or modulated signals over the house AC power lines. It will be appreciated that the sending unit can be a timer, an on-off switch, or other type of control device.

Figure 8:
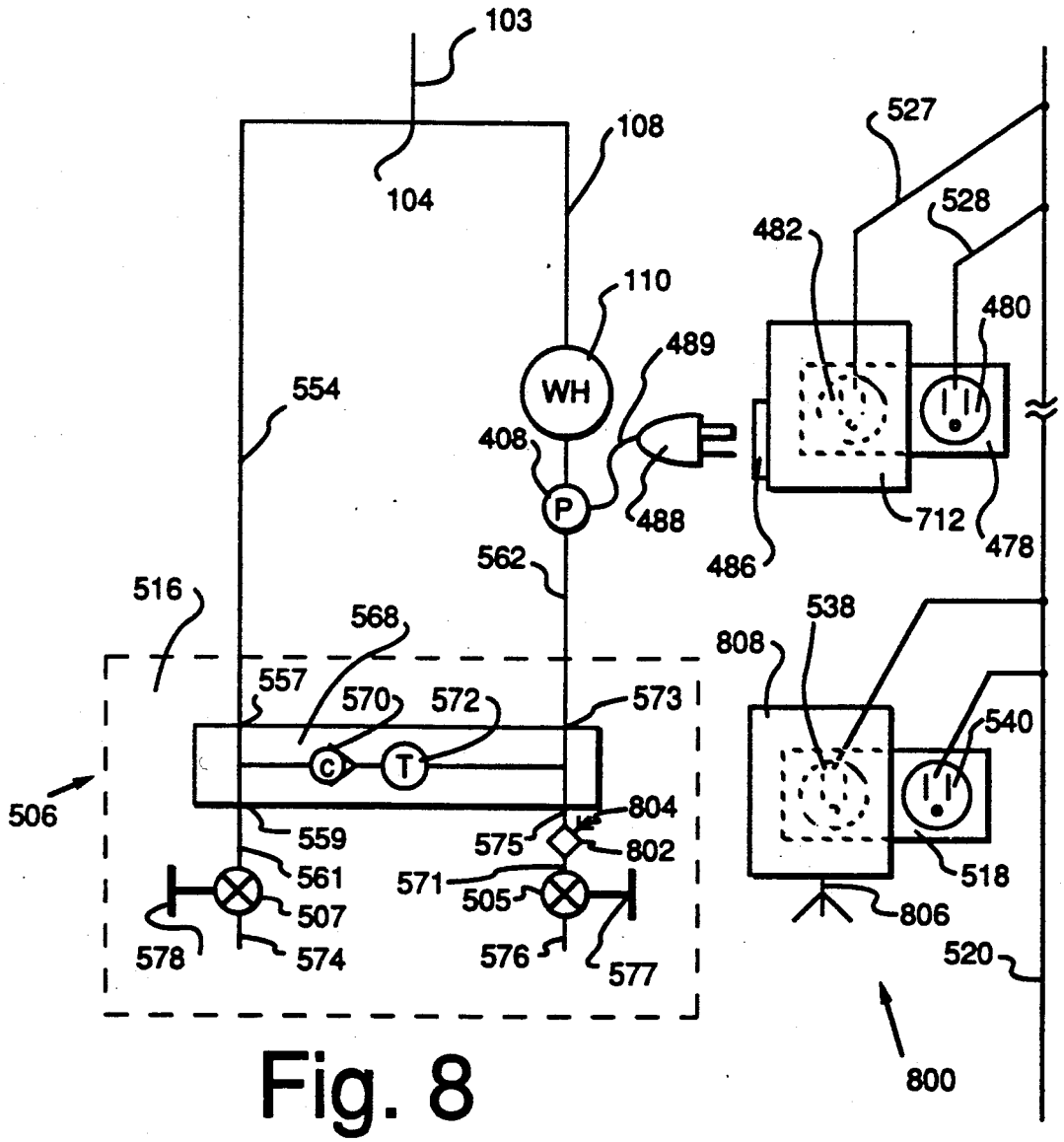
FIG. 8 is a schematic drawing of another alternate embodiment the recirculation hot water system, wherein control signals are transmitted by radio frequency signals and by hardwire means.

Another alternative embodiment utilizes a modulated radio carrier wave in concert with modulated signal waves carried by the house AC power lines. Referring now to FIG. 8 wherein is schematically illustrated a system 800 utilizing both radio carrier waves and modulated signals over the house power lines to transmit command signals. The system 800 is essentially identical to the system 700 except that a thermal sensor 802 is installed in the hot water supply pipe 585. A transmitting antenna 804 is mounted on the thermal sensor 802. A receiving antenna 806 is mounted onto a signal receiving unit 808. The unit 808 is plugged into the receptacle 538 which is contained in the wall unit 518. The receptacle 538 is communicatively coupled to the main power line 520 via a power line 521. The signal receiving unit 584 which supplies power to the motor of the pump 408 is plugged into the receptacle 482 which is communicatively coupled via the power line 527 to the main power line 520. As explained earlier, the power lines 520, 521, and 527 represent both supply and return AC power lines.

In operation, when the thermal sensor 802 senses the water temperature in the supply pipe 571 at a predetermined temperature level, then a signal is transmitted via radio carrier waves from the transmitting antenna 804 to the receiving antenna 806. The signal is then sent by the sending unit 808, via modulated signals, over the house AC power lines 521, 520 and 527 to the signal receiving unit 484. The signal receiving unit then isolates power from the pump motor thereby de-energizing the pump 408. The thermostat 572 operates as described earlier to isolate the pipe 562 from the pipe 554. Thus, if the valve 505 is opened, "hot" water flows out of spout 576.

However, if the thermal sensor 802 senses the water temperature in the pipe 571 below the predetermined temperature level, then another signal is transmitted from the transmitting antenna 804, via radio waves, to the receiving antenna 806. The signal received by the antenna 806 is transmitted by the sending unit 808, via the power lines 521, 520, and 527, to the receiving unit 484. The unit 484 then allows the pump motor to be energized. As described earlier, the thermostat 572 opens the orifice. Since the pump motor is energized, water is circulated from the hot water supply piping into the cold water supply/return piping.

Figure 9:
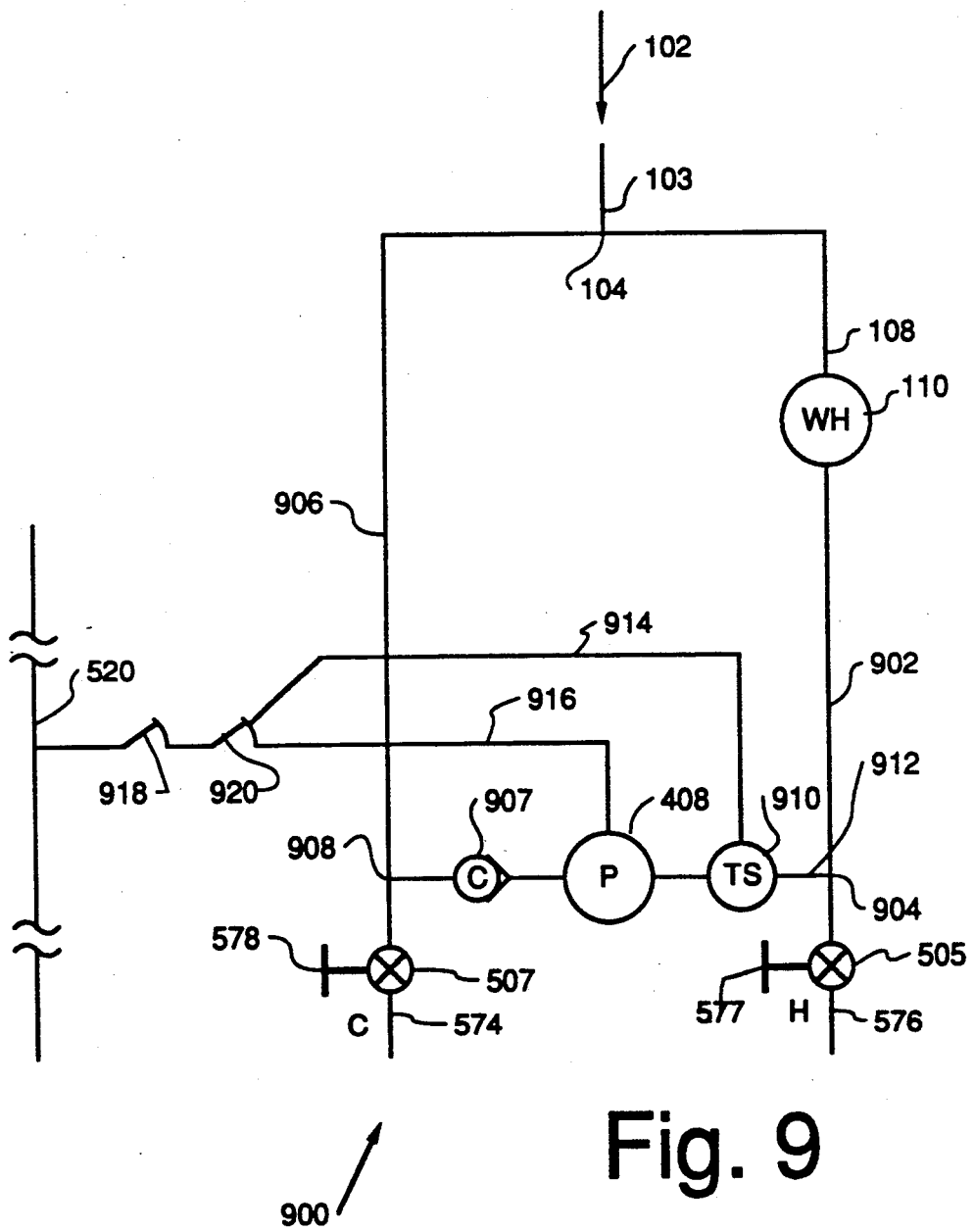
FIG. 9 is a schematic drawing of yet another alternate embodiment of the recirculation hot water system, wherein the operation of the pumping device is controlled by a manually positioned switch.

Yet another embodiment of the present invention is a system that requires the user to either turn on a light switch or be detected by a proximity switch. Referring now to FIG. 9 wherein is schematically illustrated a "man-in-the-loop" system 900. In a nominal potable water delivery system a hot water supply pipe 902 is communicatively coupled to the cold water supply pipe 906, via a cross-connect pipe 912 and the T-joints 904 and 908. A thermal switch 910, a pump 408, the check valve 907 are installed in the pipe 912. The thermal switch 910 is installed upstream of the check valve 907. The is communicatively coupled to the pump 408 and a T-joint 904 that has been installed in a water heater outlet pipe 902. The thermal switch 910 is also in electronic communication, via a temperature signal line 914, to a switch 920. The pump 408 is also in electronic communication, via a pump power signal line 916, to the switch 920. The switch 920 is installed in series with a switch 918, and both switches are electronically coupled to the main power line 520.

In operation, the thermal switch 910 will close the switch 920 if temperature in the hot water supply pipe 902 is below a predetermined temperature level (i.e. the water is "cold"). When the switch 920 is closed, the pump motor can be energized if and only if the switch 918 is also closed. The hot water valve 505 should not be opened until the pump stops operating. The pump motor is de-energized when it is turned off by the opening of the thermal switch 918, that is, when hot water is available.

When the water temperature rises above the predetermined temperature level (i.e. becomes "hot"), the thermal switch 910 is off and the switch 920 is open. The pump will not operate even though the switch 918 is closed. The hot water valve 505 may be opened and hot water will be immediately available through the spout 576.

Figure 10:
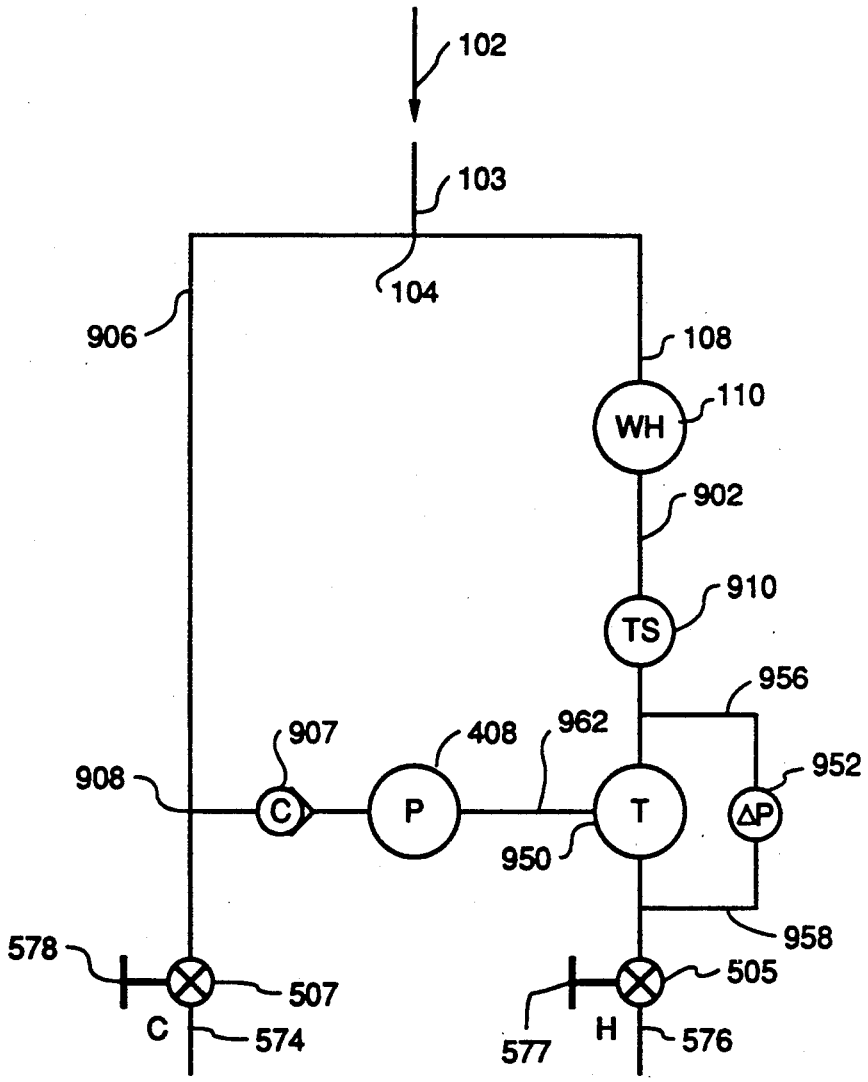
FIG. 10 is a schematic drawing of still another alternate embodiment of the recirculation hot water system, wherein the operation of the pumping device is controlled by a differential pressure switch.

Yet another alternative embodiment would be a potable water delivery system that is fully automatic and self-contained. FIG. 10 schematically illustrates a demand system 1000 that only operates when the hot water valve 505 is opened. Such a system would be required for each pair of valves in the home. A crossover pipe 962 is installed so as to fluidly communicate the pipe 902 with the pipe 906. The pump 408, and the check valve 907 are installed in the pipe 962. In addition, a thermostat 950 is installed at the junction of the hot water outlet piping 902 and the crossover pipe 962. A differential pressure switch 952 is installed across the thermostat 950 via a pipe 956, and a pipe 958. Also, a thermal switch 910 is installed upstream of the thermostat 950 in pipe 902.

In operation, the differential pressure switch 952 will switch "on" when a pressure difference exists across the thermostat 950. The thermal switch 910 will switch "on" when the water in pipe 902 is below a predetermined temperature level (i.e. the water is "cold"). The pump motor will be switched "on" only when the switch 952 and the switch 910 are "on".

To operate the system, the valve 505 is opened. If the temperature of the water flowing from the spout 576 is above the predetermined temperature level (i.e. "hot"), the thermostat 950 will be opened and the hot water will flow. If the water is "cold", the thermostat 950 will be closed, and no water will flow. Since the valve 505 is open and the thermostat 950 is closed, there is a pressure drop across the thermostat 950 and the switch 952 will be "on". Also, since the water is cold, the switch 910 will also be "on"; with both switches "on", the pump motor is energized and water is circulated from pipe 902 to pipe 906; no water flows out of spout 576.

When the water becomes "hot", the thermostat 950 opens and "hot" water flows from the spout 576. Since the water is now "hot", the switch 910 will switch "off" and the pump motor will be de-energized. There will be no pressure drop, across the thermostat 950, when the thermostat 950 is open, thus the pressure differential switch 952 will be switched "off". The pump motor is de-energized and water can flow from spout 576.

Although a preferred and alternate embodiments of the present invention have been disclosed above, it will be appreciated that numerous alterations and modifications thereof will no doubt become apparent to those skilled in the art after having read the above disclosures. It is therefore intended that the following claims be interpreted as covering all such alterations and modifications as fall within the true spirit and scope of the invention.

What is claimed is:

1. A system for delivering, to a demand site located in a home, a quantity of potable water, at an ambient temperature and at an elevated temperature, comprising:

a main potable water delivery path for generally directing said potable water;

a closeable bifurcated flow path communicatively coupled to said main delivery path and for directing said water to said demand sites, said bifurcated path including a first flow path for directing said potable water generally at said elevated temperature, and a second flow path for directing said potable water generally at said ambient temperature;

heater means installed in said first flow path, for heating said potable water to said elevated temperature;

a manifold including a temperature responsive valve, a first inlet, a second inlet, a first outlet, and a second outlet, wherein said first inlet connection is communicatively coupled to said first flow path and said second inlet connection is communicatively coupled to said second flow path, and said manifold is internally ported so as to communicatively couple said first flow path to said second flow path, wherein said temperature responsive valve is responsive to a temperature of said water flowing in said first flow path and is operative to permit said water to flow from said first flow path, through said manifold, and into said second flow path if said temperature is below a predetermined temperature level:

pump means inserted in said first flow path between said heater means and said manifold, for pumping said water at said elevated temperature through said first flow path:

faucet means communicatively coupled to said first outlet and said second outlet, for delivering said water to said demand site;

actuation means for selectively energizing said pump means to cause water to flow;

whereby if said pump means is energized and if said water flowing in said first flow path is below said predetermined temperature level, then said pump means causes said water to flow from said first flow path, through said manifold, into said second flow path until said actuation means de-energizes said pump or said water flowing in said first flow path is at or above said predetermined temperature level.

2. A system for delivering a quantity of potable water, at an ambient temperature and at an elevated temperature, as described in claim 1, wherein said actuation means includes:

an power distribution means for supplying power and for transmitting modulated signals;

a sending unit for generating a command signal, said sending unit is plugged into a first outlet that is located in close proximity to said demand site;

a receiving unit responsive to said command signal and operative to selectively energize said pump means, said receiving unit communicatively coupled to said pump means and plugged into a second outlet that is located in close proximity to said pump means, said second outlet communicatively coupled to said first outlet via said power distribution means; and whereby said sending unit generates said command signal that is modulated and transmitted over said power distribution means to said receiving unit, and said receiving unit in response to said command signal is operative to selectively energize said pump means.

3. A system for delivering a quantity of potable water, at an ambient temperature and at an elevated temperature, as described in claim 1, wherein said actuation means includes:

a power distribution means for supplying power to a plurality of locations throughout said home;

a sending unit for generating a command signal and located in close proximity to said demand site, said sending unit including a transmitting antenna for transmitting said command signals via radio frequency waves;

a receiving unit responsive to said command signal and operative to selectively energize said pump means, wherein said receiving unit including a receiving antenna for receiving said command signals output from said transmitting antenna, also said receiving unit communicatively coupled to said pump means and plugged into an outlet that is located in close proximity to said pump means, with said second outlet communicatively coupled to said power distribution means; and whereby, said sending unit generates said command signal that is transmitted from said transmitting antenna, via radio frequency waves, to said receiving antenna and said receiving unit, said receiving unit in response to said command signal is operative to selectively energize said pump means.

4. A system for delivering a quantity of potable water, at an ambient temperature and at an elevated temperature, as described in claim 1, wherein said actuation means includes:

a power distribution means for supplying power to a plurality of locations throughout said home;

a sending unit for generating a command signal, said sending unit including a transmitting antenna for transmitting said command signals via radio frequency waves, and plugged into a first outlet that is located in close proximity to said demand site;

a receiving unit responsive to said command signal and operative to selectively energize said pump means, wherein said receiving unit includes a receiving antenna for receiving said command signals output from said transmitting antenna, also said receiving unit communicatively coupled to said pump means and plugged into a second outlet that is located in close proximity to said pump means, with said second outlet communicatively coupled to said first outlet via said power distribution means;

a thermal sensor for sensing the temperature of said water exiting said manifold from said first outlet and in response thereto generating said command signal, wherein said sensor is inserted between said faucet means and said manifold, immediately upstream of said first outlet, and includes a transmitting antenna for transmitting said command signal via radio frequency waves;

whereby said sensor in response to the temperature of said water exiting said manifold from said second outlet, generates said command signal that is transmitted from said transmitting antenna, via radio frequency waves, to said receiving antenna on said sending unit, said sending unit in response to said command signal is operative to generate a second command signal that is modulated and transmitted over said power distribution means to said receiving unit, and said receiving unit in response to said command signal is operative to selectively energize said pump means.

5. A system for delivering a quantity of potable water, at an ambient temperature and at an elevated temperature, as described in claim 1, wherein said manifold includes:

a generally tubular shaped body including a longitudinal axis and an axial axis of orientation, and further including a wall, first open end, a second open end, and a main passageway disposed longitudinally through said body communicatively coupling said first and second ends;

a first end plug disposed in said first open end, said plug generally circular in shape and having an inner face and an outer face;

a second end plug disposed in said second open end, said plug generally circular in shape and having an inner face and an outer face;

a hot water passageway formed through said wall near said first open end and formed in a generally axial direction of orientation wherein said main passageway and said hot water passageway are generally perpendicular to each other, said hot water passageway being in fluid communication with said main passageway via a chamber;

a cold water passageway formed through said wall near said second open end and formed in a generally axial direction of orientation wherein said main passageway and said cold water passageway are generally perpendicular to each other, said cold water passageway being in fluid communication with said main passageway via an orifice, wherein said water can flow from said hot water passageway, through said main passageway, through said orifice, into said cold water passageway;

check valve means disposed at junction of said main and cold water passageways to prevent said water from flowing from said cold water passageway, through said orifice, through said main passageway, and into said hot water passageway;

a thermal actuator disposed in said chamber and generally cylindrical in shape with a bottom end and a top end, said bottom end disposed onto said inner face of said first end plug, said top end slidably disposed within a shuttle;

spring-biased sealing means generally tubular in shape with a top end and a bottom end, said bottom end disposed onto said shuttle and said top end circumferentially sized to be slidably disposed within said orifice thereby sealing said orifice; and whereby said thermal actuator responds to an increase in the temperature of said water flowing in said hot water passageway by longitudinally extending into said main passageway thereby slidably disposing said seal into said orifice and thereby preventing said water from flowing from said hot water passageway, through said main passageway, and into said cold water passageway, in the alternative, said thermal actuator responds to a decrease in the temperature of said water flowing in said hot water passageway by longitudinally contracting into said main passageway thereby slidably removing said seal out of said orifice and thereby allowing said water to flow from said hot water passageway, through said main passageway, and into said cold water passageway.

* * * * *